US006394008B1

(12) United States Patent
Bauver, II et al.

(10) Patent No.: US 6,394,008 B1
(45) Date of Patent: May 28, 2002

(54) SPLITTER PLATE ARRANGEMENT FOR A FLUE GAS STACK

(75) Inventors: Wesley P. Bauver, II, Granville, MA (US); Matthew J. Dooley, Granby, CT (US); Bernard H. Walsh, Feeding Hills, MA (US)

(73) Assignee: ALSTOM (Switzerland) Ltd, Baden (CH)

( * ) Notice: Subject to any disclaimer, the term of this patent is extended or adjusted under 35 U.S.C. 154(b) by 0 days.

(21) Appl. No.: 09/769,708

(22) Filed: Jan. 25, 2001

(51) Int. Cl.[7] ..... F23J 11/00

(52) U.S. Cl. ..... 110/184; 110/203; 110/123; 126/312; 126/307 R; 126/80

(58) Field of Search ..... 110/184, 203, 110/207, 309, 310, 104 A, 123, 124, 129, 163; 52/218, 219, 246; 104/52; 114/187; 454/2; 126/312, 307 R, 85 B, 80

(56) References Cited

U.S. PATENT DOCUMENTS

,432,544 A * 7/1890 Moore ..... 110/184
1,461,606 A * 7/1923 Elick ..... 110/184
2,203,317 A * 6/1940 Wolden ..... 110/184
3,631,655 A * 1/1972 Mullen ..... 55/133
4,302,425 A * 11/1981 Gamel ..... 422/161
5,947,110 A * 9/1999 Malo et al. ..... 126/312
6,053,162 A * 4/2000 Godfree et al. ..... 126/85 B

* cited by examiner

*Primary Examiner*—Ira S. Lazarus
*Assistant Examiner*—K. B. Rinehart
(74) *Attorney, Agent, or Firm*—Russell W. Warnock

(57) ABSTRACT

A splitter plate arrangement is provided for controlling the flow of flue gas in a vertical stack. The splitter plate arrangement 100 is operable to control the flow of flue gas in a vertical stack 128 having an annular entry 130 communicated with two inlets 126A, 126B which each communicate a respective one of the flue gas producers with the vertical stack 128. The inlets 126A, 126B are both disposed on a common inlet axis which bisects the annular entry 130 into two bisected halves, the two inlets 126A, 126B are oriented in opposition to one another such that the inlet flow 132 of flue gas through the inlet 126A flows in a direction opposite to the inlet flow 134 of flue gas through the inlet 126B. The splitter plate arrangement 100 includes a first splitter plate 136 and a second splitter plate 138. The first splitter plate 136 extends radially inwardly from the inner surface of the vertical stack 128 at generally the midpoint MDOT of one bisected half of the annular entry 130 of the vertical stack on one respective side of the inlet axis 1A. The second splitter plate 138 extends radially inwardly from the inner surface of the vertical stack 128 at generally the midpoint MDOB of the other bisected half of the annular entry 130 of the vertical stack 128 on the other respective side of the inlet axis 1A.

6 Claims, 5 Drawing Sheets

SPLITTER PLATE ARRANGEMENT FOR A FLUE GAS STACK

BACKGROUND OF THE INVENTION

This invention relates to a splitter plate arrangement for a flue gas stack.

Power generation facilities and numerous other facilities which produce fossil fuel combustion gas emissions including pollutants typically comprise a vertical flue gas or exhaust stack through which the exhaust gases are flowed to be released to the atmosphere. The levels and characteristics of such released gas emissions often must be in accord with statutory or regulatory limits. Thus, it can be understood that accurate and repeatable determinations must be made concerning the emission levels and characteristics so that compliance with the statutory or regulatory limits can be assured.

One commonly measured emission characteristic which relates to the pollutant contribution of a flue gas emission is the flow rate of the flue or exhaust gas through the stack. However, accurate measurement of the flue gas flow rate is complicated by the flow pattern of the flue gas in the stack and the configuration of the flue gas flow path at the entrance of the stack significantly influences this flow pattern. The flow patterns in cylindrical flue gas stacks formed by the flow of the flue gas from a horizontal or near horizontal duct into the stack can best be described by two counter-rotating vortices within the stack. These vortices are unstable and interact with each other as the flue gas travels up the stack in a spiral pattern. The swirling flow in the stack is controlled by one of the two counter-rotating vortices. Flow instabilities can result in a momentary change in direction of the swirl as the opposing vortex gains control.

Thus, the gas flow in the exhaust stack is often turbulent and has a rotating component. These factors complicate the task of accurately measuring the gas flow rate by a Pitot or other pressure type probe.

Moreover, the flow pattern in the exhaust stack can result in pressure pulsations which travel back through the plant equipment which is upstream of the exhaust stack. This can have an adverse effect on the operation and structural integrity of the process and equipment. As one example, combustion gas turbines are often used to provide electric power usually for standby or peaking power. Because the thermal efficiency of gas turbines alone is rather low due to the high exit gas temperature, the gas turbine is most often combined with a heat recovery steam generator and a steam turbine to produce additional electricity. As a combination of a gas turbine cycle and a steam turbine cycle, these systems are referred to as "combined cycles". Gas turbines with heat recovery steam generators are also used to produce process steam in co-generation plants.

In the situation of combined cycles or co-generation, the pressure pulsations previously referred to travel upstream through the heat recovery steam generator and through the inlet duct to the interface with the gas turbine. Although the interaction of the pressure pulsations with the gas turbine are not fully known, it is hypothesized that the pulse is reflected off of the rotating blades of the turbine and then travels back downstream. Measurements have shown that the turbine back pressure can vary as much as 10% depending on the amplitude of the pulse. Of course, such a large variation in back pressure can have a negative impact on the operating stability of the gas turbine. Furthermore, such pressure swings can have long term risks associated with material fatigue and stress. These same operating and structural problems will also exist to varying degrees with combustion equipment other than combined cycle systems.

An additional benefit of the splitter plate arrangement, as demonstrated in laboratory tests, is the reduction in the pressure drop between the inlet or breech and the exit of the stack. The reduction of the pressure drop reduces fan power consumption and thereby increases the overall efficiency of the power plant by reducing parasitic power consumption.

Accordingly, deductive reasoning draws the conclusion that, if the accuracy and repeatability of flue gas flow rate measurement could be improved, the reliability of reported flow rates would be improved. Furthermore, the operators of power generation facilities and other emission producing facilities could plan their operations with more confidence and efficiency in reliance upon the accurately measured flue gas flow rates. Moreover, it would be advantageous if any approach which yields an improvement in measuring flue gas flow rates also yields other benefits such as reducing flow instabilities which can have an adverse effect of the operation and structural integrity of the process or equipment and can reduce, in most cases, the gas pressure loss through the stack.

It is, therefore, an object of the present invention to provide a new and improved splitter plate arrangement which sets up conditions within a flue gas exhaust stack such that an accurate and repeatable measurement of the flue gas flow rate can be obtained.

It is a further object of the present invention to provide such a new and improved splitter plate arrangement which is characterized by its capacity to reduce flow turbulence and pressure drop in a flue gas exhaust stack as compared with conventional splitter plate arrangements.

SUMMARY OF THE PRESENT INVENTION

In accordance with one aspect of the present invention, there is provided a splitter plate arrangement for a flue gas stack. The splitter plate arrangement controls the flow of flue gas in a vertical stack having an annular entry communicated with two inlets both disposed on a common inlet axis which bisects the annular entry into two bisected halves, the two inlets being oriented in opposition to one another such that the inlet flows of flue gas through the opposed inlets are in opposed directions to one another. The splitter plate arrangement includes a first splitter plate and a second splitter plate. The first splitter plate extends radially inwardly from the inner surface of the vertical stack at generally the midpoint of one bisected half of the annular entry of the vertical stack on one respective side of the inlet axis. The second splitter plate extends radially inwardly from the inner surface of the vertical stack at generally the midpoint of the other bisected half of the annular entry of the vertical stack on the other respective side of the inlet axis.

According to further features of the one aspect of the present invention, the first and second splitter plates each have a radial extent of between about twenty-five percent (25%) to fifty percent (50%) of the radius of the annular entry of the vertical stack. Also, the first and second splitter plates each have a vertical extent greater than the vertical extent of the inlets.

According to yet additional features of the one aspect of the present invention, each inlet is formed as a quadrilateral opening. Also, the first and second splitter plates are each quadrilateral in shape.

In a variation of the one aspect of the present invention, the respective pair of ducts entering the stack are at an included angle which is other than one hundred and eighty (180) degrees such as, for example, one hundred and fifty (150) degrees or less.

DESCRIPTION OF THE PREFERRED EMBODIMENT

Although the present invention can be employed in a variety of situations where the flue gases which have been generated are emptied from a horizontal duct into a cylindrical flue gas stack, an exemplary illustration of the preferred embodiment of the splitter plate arrangement will now be set forth in connection with a deployment of the splitter plate arrangement in an application involving gas turbines (combined cycles and co-generation cycles) where pressure pulses and variations in back pressure can be the most harmful. Therefore, the invention will be described with specific reference to a combined cycle system recognizing that the invention is not to be limited accordingly.

Figure 1:
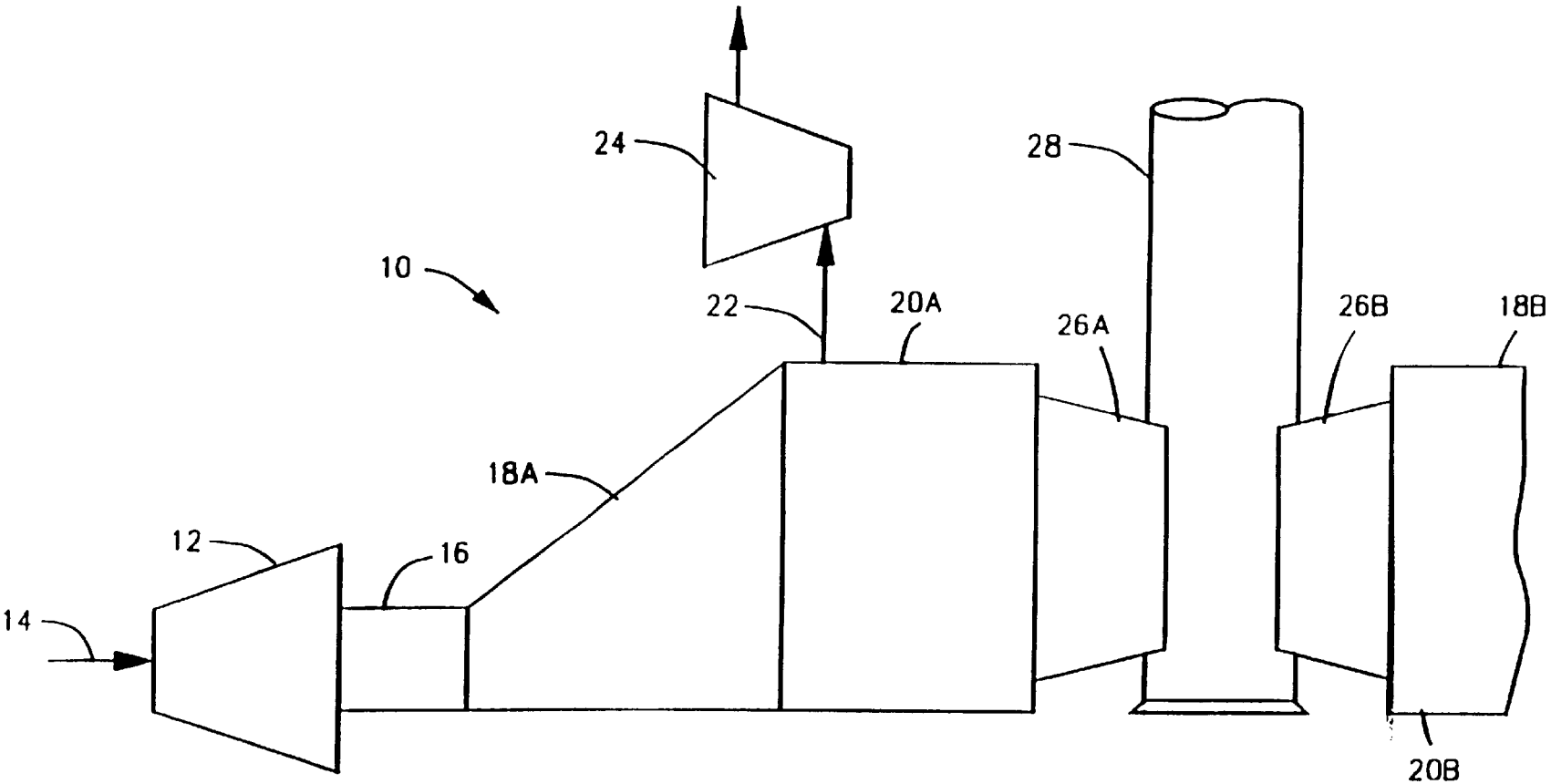
FIG. 1 is a side view of a basic combined cycle system including the connection of a heat recovery steam generator of a flue gas stack.

FIG. 1 illustrates a combined cycle system generally designated 10 including a gas turbine 12, which would be connection in with a compressor and an electric generator in a conventional manner, fed with fuel and air at 14. The hot flue gas produced in the gas turbine 12 is exhausted through duct 16 into the expanding inlet transition ducts 18A, 18B of a pair of heat recovery steam generators 20A, 20B. The heat recovery steam generator 20A, 20B contains the conventional heat transfer surface for steam generation and may also contain features such as catalytic nitrogen oxide reduction equipment. The steam from the heat is fed at 22 to the steam turbine 24.

As also shown in FIG. 1, the flue gas, which is now partially cooled, exits the heat recovery steam generator 20A, 20B through an inlet 26A, 26B which is often referred to in the art as the breech. The inlet 26A, 26B, which is normally either a square or a rectangular duct as illustrated, is connected into the stack 28 at the lower end thereof.

The flue gas produced by the heat recovery steam generator 20A which enters the vertical stack 28 via the inlet 26A moves in a spiral gas flow vortice VO1 as it enters the vertical stack and the flue gas produced by the heat recovery steam generator 20B which enters the vertical stack 28 via the inlet 26B moves in a spiral gas flow vortice VO2 as it enters the vertical stack. These spiral gas flow vortices VO1 and VO2 create turbulence and transient swirling flow in the vertical stack 28 which persists for the full length of the vertical stack. This flow pattern can introduce significant errors in flow rate measurement in the event that the flow rate measurement of the flue gas in the vertical stack 28 is performed by, for example, a differential pressure type probe mounted at or in the vertical stack 28 such as, for example, a Pitot type probe, a Staubscheibe type probe, or an "S" type probe.

Figure 2:
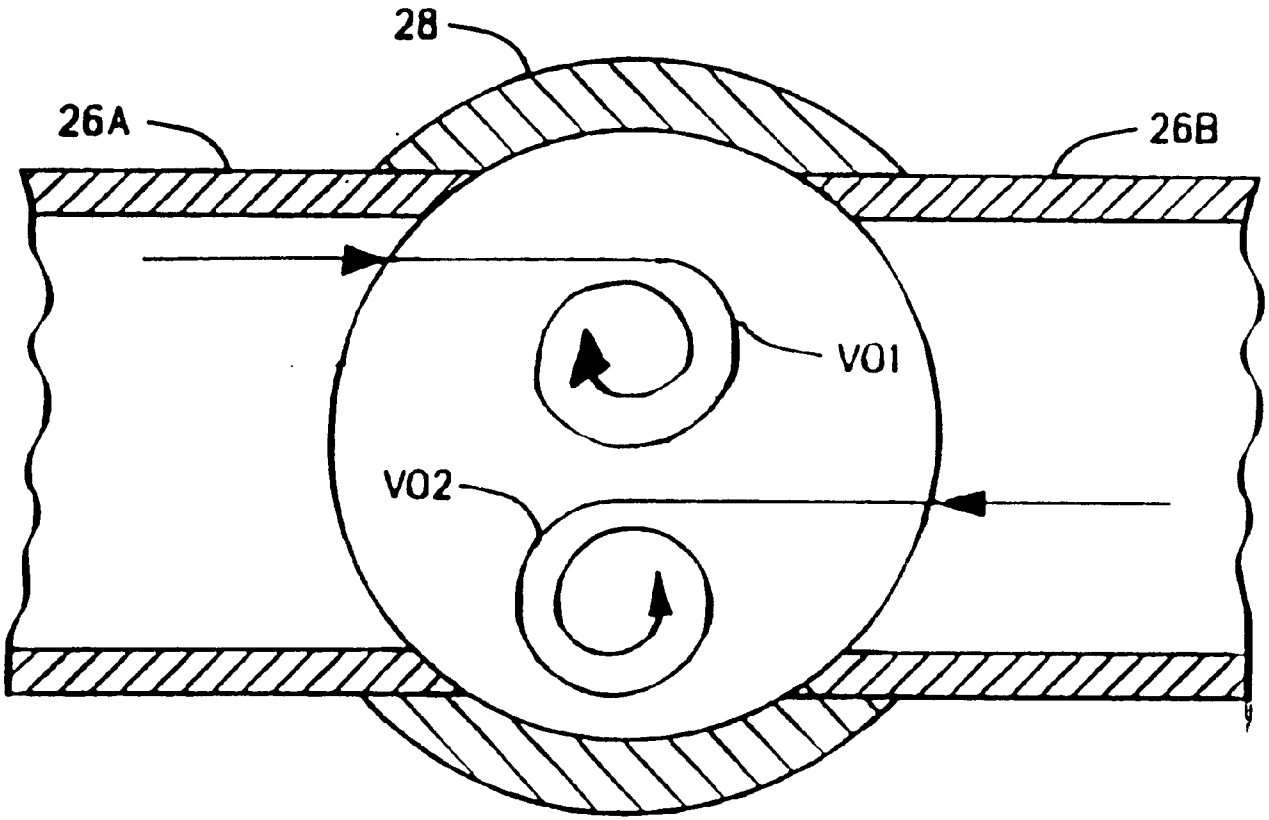
Figure 2 (PRIOR ART)
FIG. 2 is a horizontal cross-sectional view of the connection of the breech to the flue gas stack illustrating the flue gas flow pattern.
Figure 3:
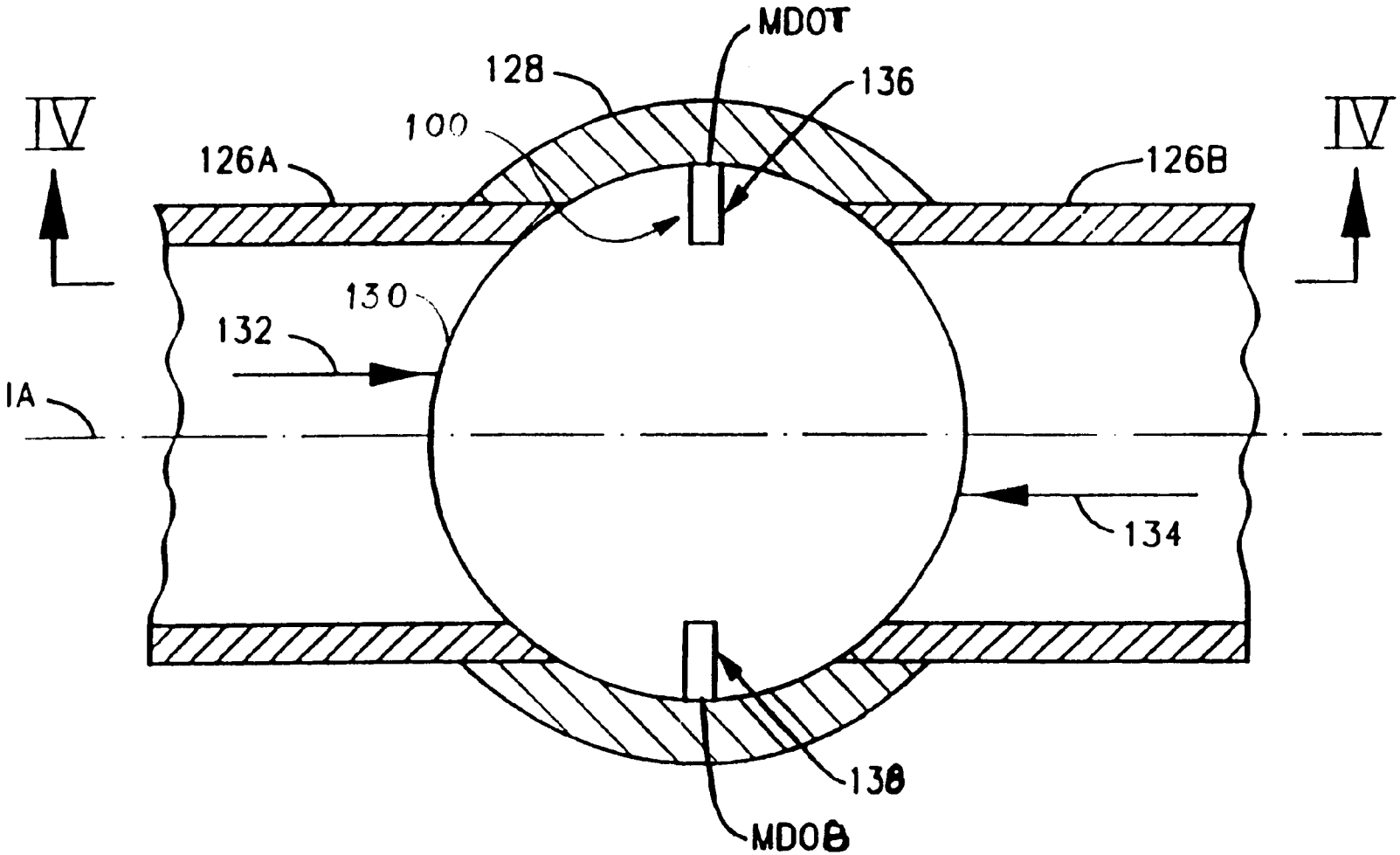
FIG. 3 is a horizontal cross-sectional view of the connection of the breech to the flue gas stack and showing the preferred embodiment of the splitter plate arrangement of the present invention.
Figure 4:
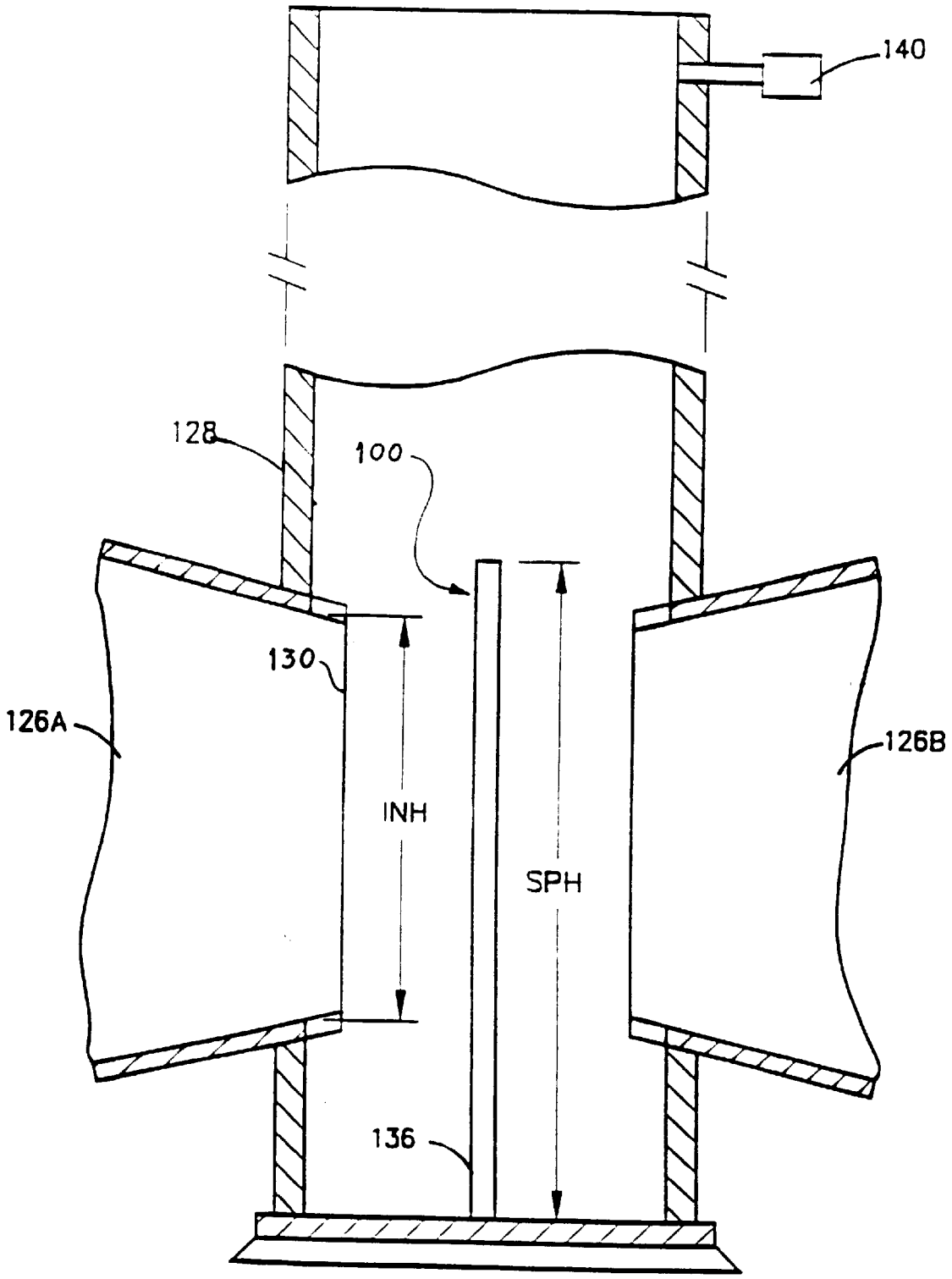
FIG. 4 is a vertical cross-sectional view taken along lines IV—IV of FIG. 3 of the entry to the flue gas stack and showing one of the splitter plates of the splitter plate arrangement.

As seen in FIGS. 3 and 4, the preferred embodiment of the splitter plate arrangement of the present invention, generally designated as the splitter plate arrangement 100, is operable to control the flow of flue gas in a vertical stack 128. The vertical stack 128 may be a vertical stack such as the vertical stack 28 described with reference to the conventional arrangement shown in FIG. 2 and operable to exhaust to atmosphere the flue gas produced by one or more flue gas producers such as, for example, the heat recovery steam generators 20A, 20B. The vertical stack 128 has an annular entry 130 communicated with two inlets 126A, 126B which each communicate a respective one of the flue gas producers with the vertical stack 128. Each inlet 126A, 126B may be configured as a quadrilateral duct such as, for example, a square or rectangular duct, and operates as a breech in the same manner as the inlets 26A, 26B described with respect to the conventional flue gas entry arrangement shown in FIG. 2. The inlets 126A, 126B are both disposed on a common inlet axis 1A which bisects the annular entry 130 into two bisected halves and the two inlets 126A, 126B are oriented in opposition to one another such that the inlet flow 132 of flue gas through the inlet 126A flows in a direction opposite to the inlet flow 134 of flue gas through the inlet 126B.

The splitter plate arrangement 100 includes a first splitter plate 136 and a second splitter plate 138. The first splitter plate 136 extends radially inwardly from the inner surface of the vertical stack 128 at generally the midpoint MDOT of one bisected half of the annular entry 130 of the vertical stack on one respective side of the inlet axis 1A. The second splitter plate 138 extends radially inwardly from the inner surface of the vertical stack 128 at generally the midpoint MDOB of the other bisected half of the annular entry 130 of the vertical stack 128 on the other respective side of the inlet axis 1A.

The first splitter plate 136 and the second splitter plate 138 each have a radial extent of between about twenty-five percent (25%) to fifty percent (50%) of the radius of the annular entry 130 of the vertical stack 128. As seen in FIG. 4, which is a vertical sectional view taken along lines IV—IV of FIG. 3, the first splitter plate 136 has a vertical extent SPH greater than the vertical extent INH of the inlets 126A, 126B. The vertical extent of the second splitter plate 138 is also preferably greater than the vertical extent NH of the inlets 126A, 126B. The first splitter plate 136 and the second splitter plate 138 are each quadrilateral in shape such as, for example, a rectangular shape with its length extent oriented vertically.

The first splitter plate 136 and the second splitter plate 138 control the flow of flue gas in the vertical stack 128 by intercepting the vortices created in the annular entry 130 by the inlet flows 132, 134 entering the annular entry 130 via the inlets 126A, 126B, respectively. By virtue of this interception of the vortices, the first splitter plate 136 and the second splitter plate 138 reduce turbulence, swirl, and stack draft loss. Additionally, the accuracy of the flow rate measurement of flue gas flowing through the vertical stack 128 by, for example, a conventional differential pressure type probe 140 communicated via a test port with the vertical stack, can be significantly improved by virtue of the flow pattern imposed by the first splitter plate 136 and the second splitter plate 138.

In one exemplary process for improving the accuracy of flow rate measurement of the flue gas flow in a vertical stack, the process may include one or all of the steps of disposing a first and second splitter plate, such as the first splitter plate 136 and the second splitter plate 138, in the vertical stack and observing the flow pattern, modeling a flow model to determine optimum location and design of the splitter plates, and relocation of the test ports.

Figure 5:
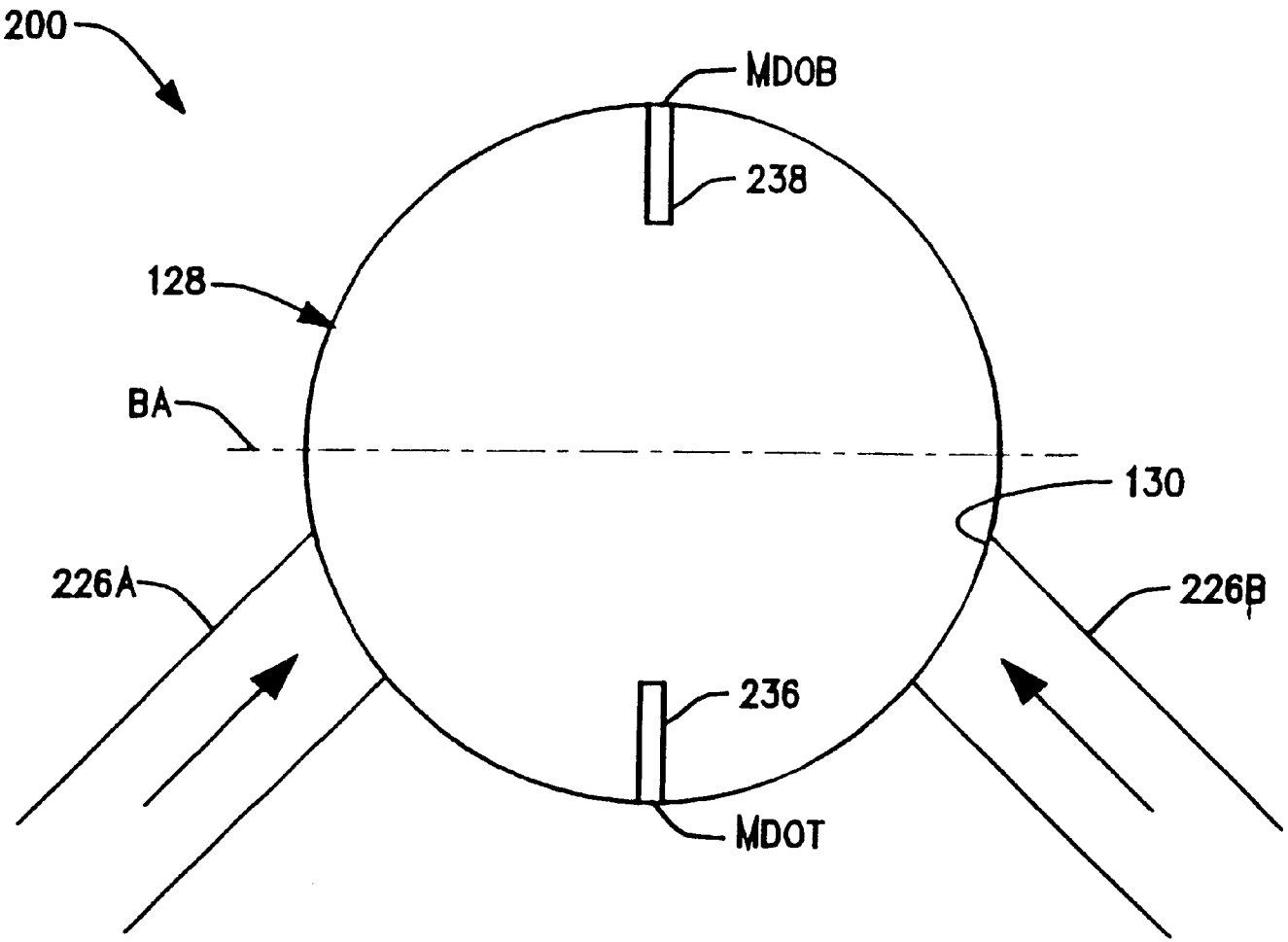
FIG. 5 is a schematic top plan view of a variation of the splitter plate arrangement of the present invention in which the splitter plates are disposed to influence the flue gas flow into the flue gas stack from a respective pair of ducts entering the stack at an included angle which is other than one-hundred and eighty (180) degrees.

FIG. 5 is a schematic top plan view of a variation of the splitter plate arrangement of the present invention in which the splitter plates are disposed to influence the flue gas flow into the flue gas stack from a respective pair of ducts entering the stack at an included angle which is other than one-hundred and eighty (180) degrees. In this variation, the present invention provides a splitter plate arrangement for controlling the flow of flue gas in a vertical stack having an annular entry communicated with two inlets and the annular entry being bisected by a bisecting axis into two bisected halves. The two inlets are oriented relative to one another at an included angle other than one-hundred and eighty (180) degrees such that the inlet flows of flue gas through the inlets are at an angle to one another and communicate into the same respective bisected half of the annular entry of the vertical stack. The splitter plate arrangement includes a first splitter plate extending radially inwardly from the inner surface of the vertical stack at generally the midpoint of one bisected half of the annular entry of the vertical stack on one respective side of the inlet axis and a second splitter plate extending radially inwardly from the inner surface of the vertical stack at generally the midpoint of the other bisected half of the annular entry of the vertical stack on the other respective side of the inlet axis.

This variation of the splitter plate arrangement of the present invention, generally designated as the splitter plate arrangement 200, is operable to control the flow of flue gas in the vertical stack 128. The vertical stack 128 has an annular entry 130 communicated with two inlets 226A, 226B which each communicate a respective one of the flue gas producers with the vertical stack 128. Each inlet 226A, 226B may be configured as a quadrilateral duct such as, for example, a square or rectangular duct, and operates as a breech in the same manner as the inlets 26A, 26B described with respect to the conventional flue gas entry arrangement shown in FIG. 2. The inlets 226A, 226B are disposed relative to one another to form therebetween an included angle of less than one hundred and eighty (180) degrees. The annular entry 130 of the vertical stack 128 has a bisecting axis BA which bisects the annular entry 130 into two bisected halves and the two inlets 226A, 226B both communicate into the same respective bisected half of the annular entry 130.

The splitter plate arrangement 200 includes a first splitter plate 236 and a second splitter plate 238. The first splitter plate 236 extends radially inwardly from the inner surface of the vertical stack 128 at generally the midpoint MDOT of one bisected half of the annular entry 130 of the vertical stack on one respective side of the bisecting axis BA. The second splitter plate 238 extends radially inwardly from the inner surface of the vertical stack 128 at generally the midpoint MDOB of the other bisected half of the annular entry 130 of the vertical stack 128 on the other respective side of the bisecting axis BA.

While there has been illustrated and described herein a preferred embodiment of the invention, it is to be understood that such is merely illustrative and not restrictive and that variations and modifications may be made therein without departing from the spirit and scope of the invention. It is, therefore, intend by the appended claims to cover the modifications alluded to herein as well as the other modifications which fall within the true spirit and scope of the invention.

What is claimed is:

1. A splitter plate arrangement for controlling the flow of flue gas in a vertical stack having an annular entry communicated with two inlets both disposed on a common inlet axis which bisects the annular entry into two bisected halves, the two inlets being oriented in opposition to one another such that the inlet flows of flue gas through the opposed inlets are aligned with the common inlet axis and in opposed directions to one another, the splitter plate arrangement comprising:

a first splitter plate extending radially inwardly from the inner surface of the vertical stack at generally the midpoint of one bisected half of the annular entry of the vertical stack on one respective side of the inlet axis, the first splitter plate extending generally orthogonally to the common inlet axis such that the first splitter plate is generally orthogonal to the inlet flows of flue gas through the opposed inlets; and a second splitter plate extending radially inwardly from the inner surface of the vertical stack at generally the midpoint of the other bisected half of the annular entry of the vertical stack on the other respective side of the inlet axis, the second splitter plate extending generally orthogonally to the common inlet axis such that the second splitter plate is generally orthogonal to the inlet flows of flue gas through the opposed inlets.

2. A splitter plate arrangement according to claim 1 wherein the first and second splitter plates each have a radial extent of between about twenty-five percent (25%) to fifty percent (50%) of the radius of the annular entry of the vertical stack.

3. A splitter plate arrangement according to claim 1 wherein the first and second splitter plates each have a vertical extent greater than the vertical extent of the inlets.

4. A splitter plate arrangement according to claim 1 wherein each inlet is formed as a quadrilateral opening.

5. A splitter plate arrangement according to claim 1 wherein the first and second splitter plates are each quadrilateral in shape.

6. A splitter plate arrangement for controlling the flow of flue gas in a vertical stack having an annular entry communicated with two inlets and the annular entry being bisected by a bisecting axis into two bisected halves, the two inlets being oriented relative to one another at an included angle other than one-hundred and eighty (180) degrees such that the inlet flows of flue gas through the inlets are at an angle to one another and communicate into the same respective bisected half of the annular entry of the vertical stack, the inlet flows of flue gas each moving into a respective spiral vortice within the vertical stack, the splitter plate arrangement comprising:

a first splitter plate extending radially; inwardly from the inner surface of the vertical stack at generally the midpoint of one bisected half of the annular entry of the vertical stack on one respective side of the inlet axis; and a second splitter plate extending radially inwardly from the inner surface of the vertical stack at generally the midpoint of the other bisected half of the annular entry of the vertical stack on the other respective side of the inlet axis, whereby the first splitter plate and the second splitter plate each intercept a respective flue gas spiral vortice within the vertical stack to thereby reduce the turbulence of the flue gas flow in the vertical stack, whereby more accurate flow measurements of the flue gas flow in the vertical stack are facilitated.

* * * * *